US006116843A

United States Patent [19]

Braud

[11] Patent Number: 6,116,843

[45] Date of Patent: Sep. 12, 2000

[54] FORK LIFT TRUCK, ADAPTED TO BE LOADED ON THE REAR OF A CARRYING VEHICLE

[75] Inventor: Marcel-Claude Braud, Champtoceaux, France

[73] Assignee: Manitou BF, Ancenis, France

[21] Appl. No.: 09/156,668

[22] Filed: Sep. 18, 1998

[30] Foreign Application Priority Data

Sep. 19, 1997 [FR] France ..... 97 11676

[51] Int. Cl.[7] ..... B66F 9/10

[52] U.S. Cl. ..... 414/665; 414/467; 414/633

[58] Field of Search ..... 414/347, 467, 414/633, 640, 641, 642, 659, 665, 909, 462

[56] References Cited

U.S. PATENT DOCUMENTS

| | | | |
|---|---|---|---|
| 2,986,295 | 5/1961 | Shaffer | 414/633 |
| 3,344,941 | 10/1967 | Mathew et al. | 414/633 |
| 3,972,427 | 8/1976 | Stanley et al. | 414/467 X |
| 4,618,306 | 10/1986 | Dorsch | 414/909 X |
| 4,859,133 | 8/1989 | Maria | 414/467 X |
| 4,880,347 | 11/1989 | Lombard | 414/665 X |
| 5,312,219 | 5/1994 | Brown | 414/663 |
| 5,370,494 | 12/1994 | Holmes et al. | 414/467 X |
| 5,549,437 | 8/1996 | Kishi | 414/467 X |
| 5,651,658 | 7/1997 | Holmes et al. | 414/467 X |

FOREIGN PATENT DOCUMENTS

| | | | |
|---|---|---|---|
| 0 643 009 | 3/1995 | European Pat. Off. . | |
| 1 049 307 | 1/1959 | Germany . | |
| 196606 | 8/1989 | Japan | 414/909 |
| 243499 | 9/1990 | Japan | 414/909 |
| 2 234 214 | 1/1991 | United Kingdom . | |

*Primary Examiner*—James W. Keenan
*Attorney, Agent, or Firm*—Young & Thompson

[57] ABSTRACT

A fork lift truck, adapted to be loaded on the rear of a carrying vehicle includes a chassis 1 bearing at least one power driven and steering rear wheel 8 and two fixed direction front wheels 16, 17. The front portion 2 of the fork lift truck that includes a mast 21 and two front wheels 16, 17, is pivotally interconnected to the chassis 1 about a vertical axis 3 so as to pivot between a use position in which the front portion 2 of the fork lift truck is aligned with the chassis 1 and a loading position in which the front portion 2 and the chassis 1 are perpendicular to each other.

16 Claims, 12 Drawing Sheets

FORK LIFT TRUCK, ADAPTED TO BE LOADED ON THE REAR OF A CARRYING VEHICLE

BACKGROUND OF THE INVENTION

This application corresponds to French application 97 11676 of Sep. 19, 1997, the disclosure of which is incorporated herein by reference.

The invention relates to a fork lift truck adapted to be loaded on the rear of a carrying vehicle, of the type comprising a chassis having at least one motor driven and steering rear wheel and two fixed direction front wheels.

Fork lift trucks adapted to be loaded on the rear of a carrying vehicle necessarily comprise a double acting mast, to be able to raise the chassis of the truck to its loaded position.

Moreover, to permit the orientation of the forks and the loading, the trucks adapted to be loaded comprise at least one steering wheel and have a reduced empty weight and size.

The above constraints exclude the use of articulated trucks with fixed direction wheels and having a large and heavy rear chassis, of the type described in the patents GE 2,234,214 and DE 10 49 307, as trucks adapted to be loaded on the rear of a carrying vehicle.

There are known fork lift trucks with telescopic or fixed masts, adapted to be loaded on the rear of a carrying vehicle, for example a truck. These fork lift trucks of known type comprise generally a chassis having a U shape opening toward the front, provided with two front wheels and a powered and steering rear wheel. Because of the absence of a counter-weight and of the reduced length of these known fork lift trucks, the load is disposed in a transport position between the wheel arms, behind the front wheels of the truck. To be able to place or remove a load on or from the bed of a truck in the case in which the front wheels cannot pass over said bed, it is then necessary to provide supplemental devices to advance the loading forks in front of the front wheels, which introduces a cantilever and limits the load that can be raised by a loaded fork lift truck to a relatively small value.

Another drawback arises from the large spacing of the front wheels, which prevents the passage of this type of loaded fork lift truck through doors, narrow passageways or within a closed truck.

There exists accordingly a need to decrease the width of the loaded fork lift trucks to permit the passage through narrow passageways, whilst maintaining good stability, low weight so as not to reduce the carrying capacity of the carrying vehicle and a reduced size in the transport position, loaded on the rear of the truck.

SUMMARY OF THE INVENTION

The invention has for its object to improve the production of loaded fork lift trucks by overcoming the drawbacks of the prior art.

The invention has for its object a fork lift truck adapted to be loaded on the rear of a carrying vehicle, of the type comprising a chassis having at least one power driven and steering wheel and two fixed direction front wheels, characterized in that the forward portion of the carriage comprising the mast and the two front wheels is pivotally articulated relative to the chassis about a substantially vertical axis, so as to pivot between a use position in which the front portion of the truck is substantially aligned with the chassis and a loaded position in which the front portion and the chassis are substantially perpendicular.

According to other characteristics of the invention:

said pivotal axis is located substantially between the front wheels and adjacent the mast;

the front wheels are disposed behind a loading apron carried by the mast and are spaced by a distance less than one meter;

the loading apron carried by the mast comprises a first apron carrying a second apron inclinable under the action of an inclination jack;

the chassis has a recess on the side corresponding to the perpendicular position of the front portion relative to the chassis;

said recess is shaped as a housing for a front wheel in the loaded position of the fork lift truck;

a portable remote control means with a cable or wireless, is provided to control the loading of the carriage on the rear of a carrying vehicle, from the ground;

the remote control is adapted to execute the following functions: raising and lowering, front and rear inclination, pivoting of the chassis between a use position and a loading position, energy cutoff and energy supply;

the remote control means comprise a box with buttons with electric switches and a contact key to cut or permit the supply of energy to the fork lift truck, and a connection means between the box with buttons and the truck;

the fork lift truck is an electric truck carrying an assembly of electric batteries under the driver's seat.

BRIEF DESCRIPTION OF THE INVENTION

The invention will be better understood from the description which follows, given by way of non-limiting example, with reference to the accompanying drawings, in which.

DESCRIPTION OF THE PREFERRED EMBODIMENTS

Figure 1:
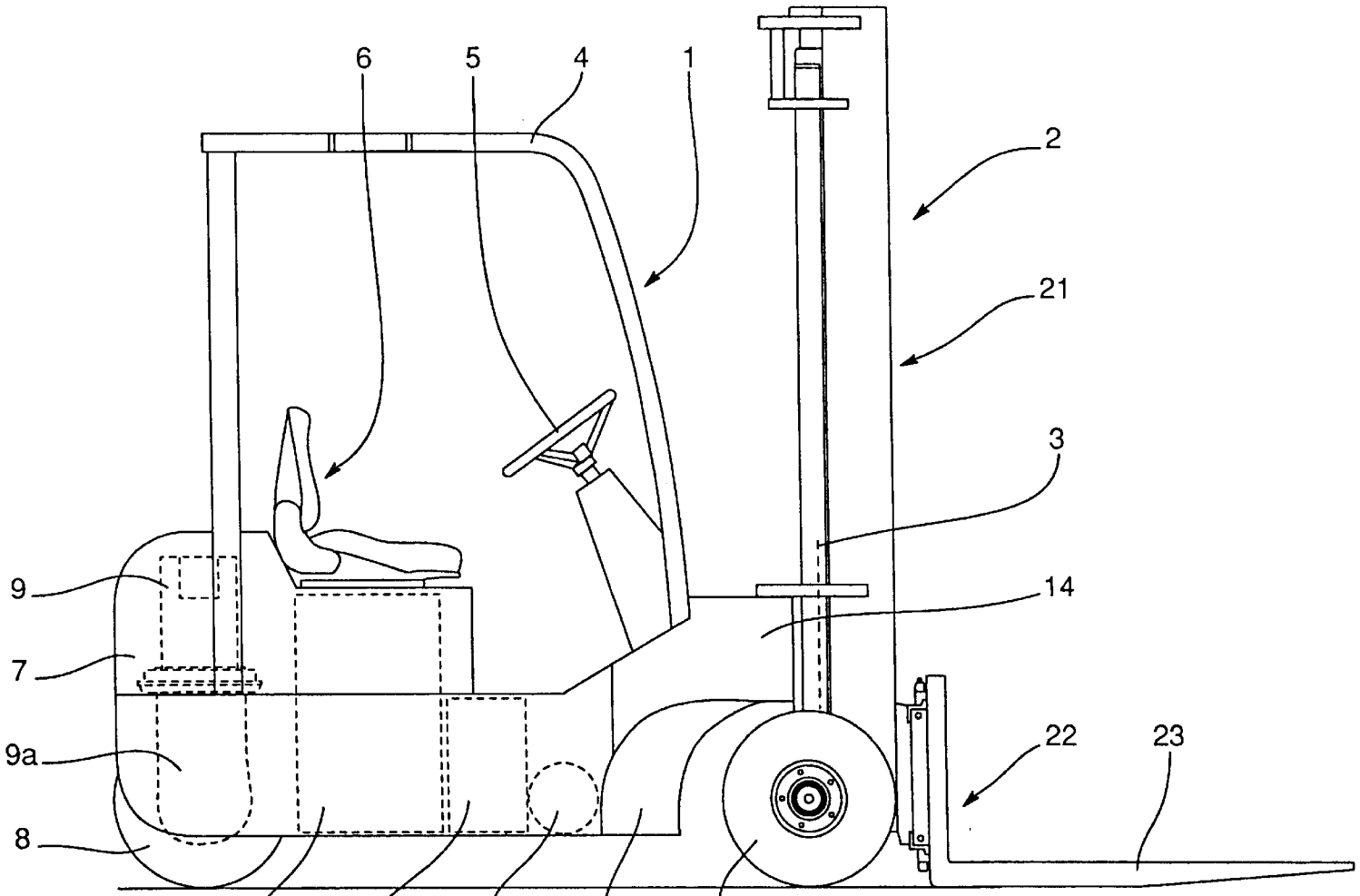
FIG. 1 is a schematic side elevational view on a fork lift truck according to the invention in use position.
Figure 2:
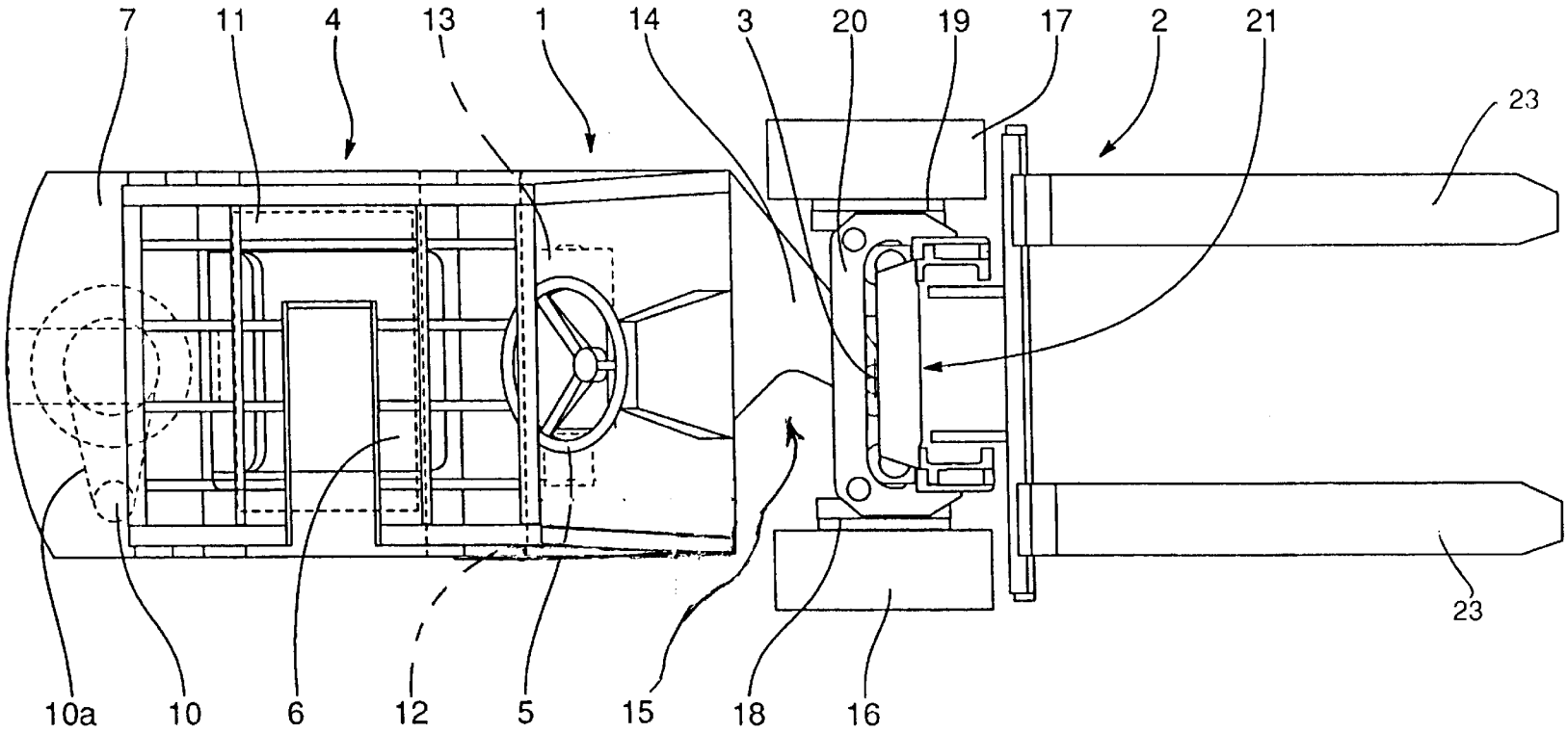
FIG. 2 is a schematic plan view of a fork lift truck according to the invention.

Referring to FIGS. 1 and 2, a fork lift truck according to the invention comprises an articulated chassis 1 with a front portion 2 articulated about a vertical axis schematically shown by the geometric axis 3. The chassis 1 comprises a cabin 4 forming a driver's station with a steering wheel 5, a seat 6 for the driver and a lower structure 7 carrying a rear power driven and steering wheel 8. The rear wheel 8 is driven by an electric driving motor 9 and steered by a hydraulic steering motor 10 by means of transmission 9*a* and 10*a*. An assembly of supply batteries 11 is provided below the seat 6 of the driver to the rear of a hydraulic reservoir 12 adjacent a hydraulic control group 13.

This example of fork lift truck according to the invention is accordingly an electric fork lift truck supplied by the batteries 11. However, the invention extends to any type of fork lift truck supplied by a heat engine or the like.

The chassis 1 is prolonged at its front end by a pivot support 14 arranged essentially on one side of the fork lift truck, such that the chassis has on the other side a recess 15 which permits the front portion 2 of the truck to take a position substantially perpendicular to the chassis 1.

Preferably, the recess 15 is shaped to permit the reception of a front wheel 16 in this perpendicular position.

The front wheels 16 and 17 are fixed direction wheels located on opposite sides of the pivot axis 3. The front wheels 16 and 17 each comprise a service brake 18 and 19 under hydraulic control. The brakes 18 and 19 can also be under mechanical control to immobilize the fork lift truck in the absence of energy supply, or other brakes (not shown) could be provided for this purpose.

The front portion 2 of the fork lift truck comprises two cross members 20 between the front wheels 16 and 17, the cross members 20 having a C shape supporting a mast 21 carrying an apron 22 provided with forks 23. The front wheels 16 and 17 ate preferably disposed to the rear of the apron 22 and spaced apart a distance less than one meter.

Figure 3:
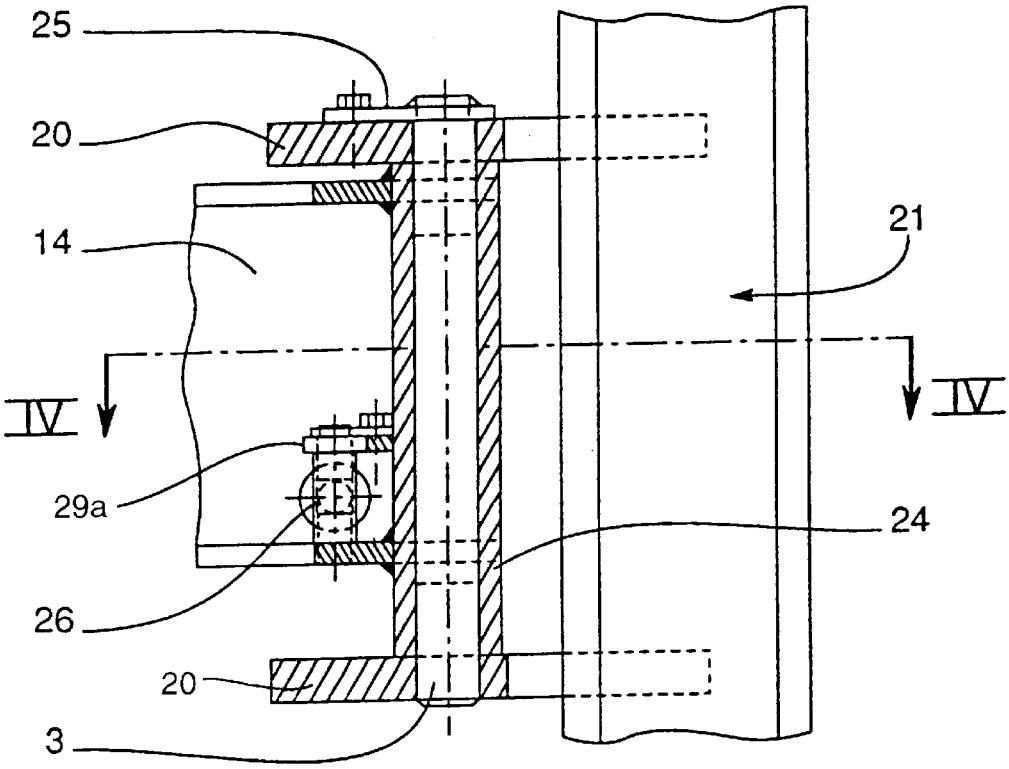
FIG. 3 is a fragmentary enlarged elevational schematic view on the line III—III of FIG. 4, of a fork lift truck according to the invention.
Figure 4:
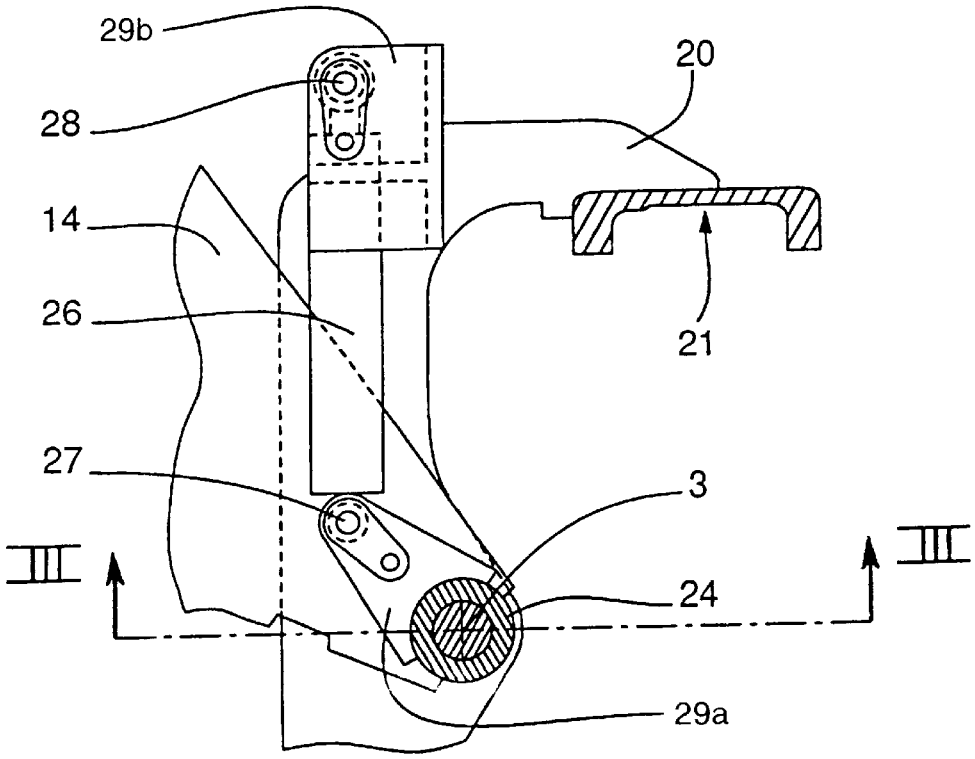
FIG. 4 is a fragmentary enlarged schematic cross-sectional view on the line IV—IV of FIG. 3, of a fork lift truck according to the invention.

With reference to FIGS. 3 and 4, the front portion 14 of the chassis 1 carries at its front end a tubular bearing 24 receiving the axle 3 of substantially vertical pivoting. The axle 3 is welded at its upper end to a stop plate 25. A member 29*a* secured to the pivot support 14 is subjected to the pressure of a jack 26 mounted on the front portion 2 to displace the front portion 2 of the fork lift truck between the use position shown, and a loading position in which this front portion 2 and the chassis 1 are substantially perpendicular.

The jack 26 exerts its pressure on an axle 27 mounted on the member 29*a* and an axle 28 mounted on an element 29*b* secured to the front portion 2 of the fork lift truck.

Figure 5:
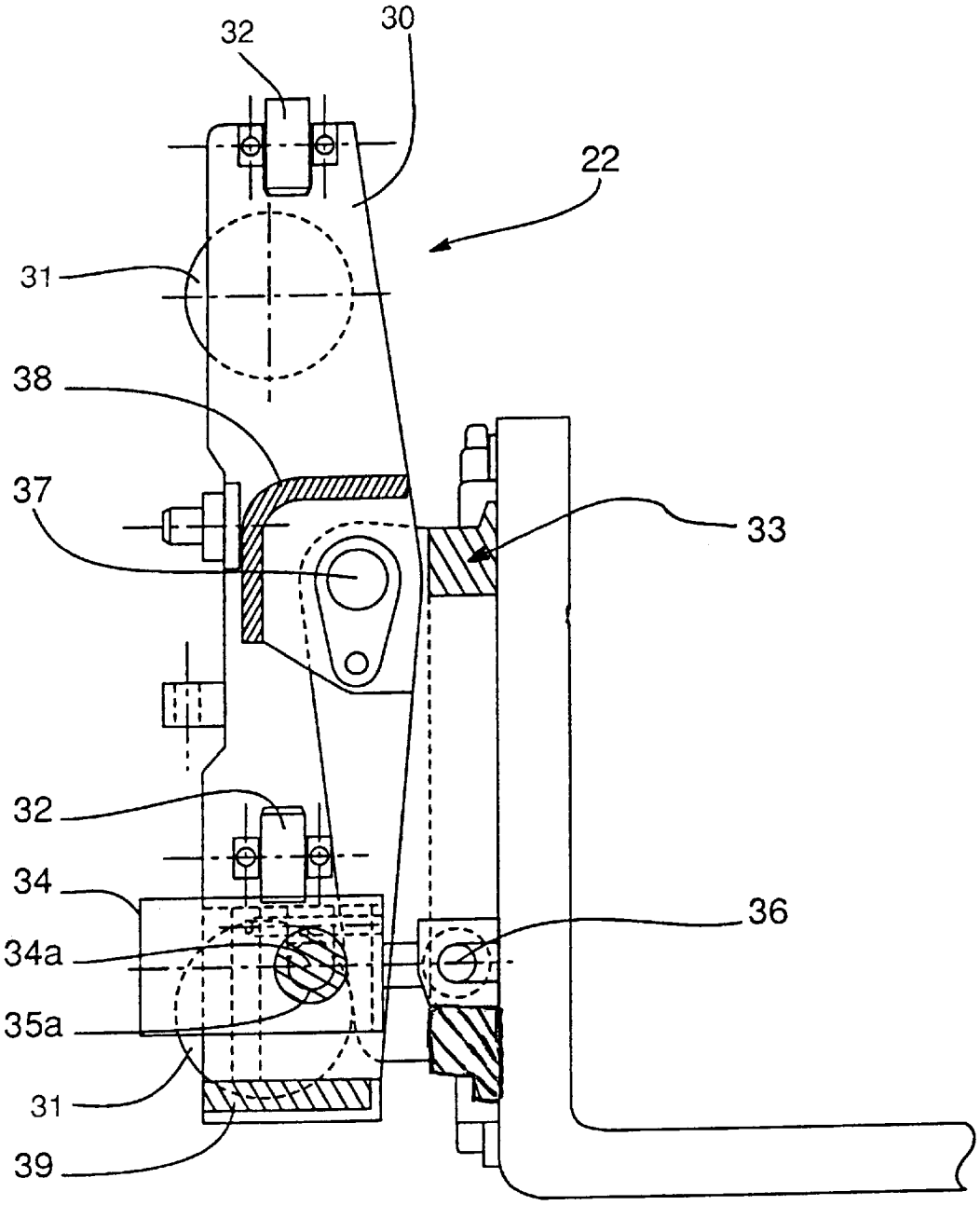
FIG. 5 is a schematic sectional view in a vertical plane of the fork lift truck apron according to the invention.

With reference to FIG. 5, the apron 22 of the fork lift truck comprises a first apron 30 mounted slidably within the mast 21 by carrying rollers 31 and guide rollers 32. The apron 30 is a first apron mounted vertically displaceably in the mast 21. This first apron 30 carries a second apron 33 inclinable under the action of the inclination jack 34. The body of the jack 34 is mounted on the first apron 30 by two pivots 34*a* disposed in bearings 35*a* only one of each of the elements 34*a*, 35*a* are shown). The piston rod of the jack 34 presses on an axle 36 secured to the inclinable apron 33. The apron 33, inclinable under the action of the inclination jack 34, pivots as a result about the substantially horizontal axle 37 on which it is mounted relative to the first apron 30.

Thick transverse connecting members 38 and 39 rigidify the first apron 30.

Referring to FIGS. 6 to 9, a fork lift truck according to the invention is loaded on the rear of a truck by engagement of the forks in a pocket according to a technique known from French patent 2.298.454 or according to a technique known from French unpublished application 96-04160, filed in the name of the present applicant.

Figure 6:
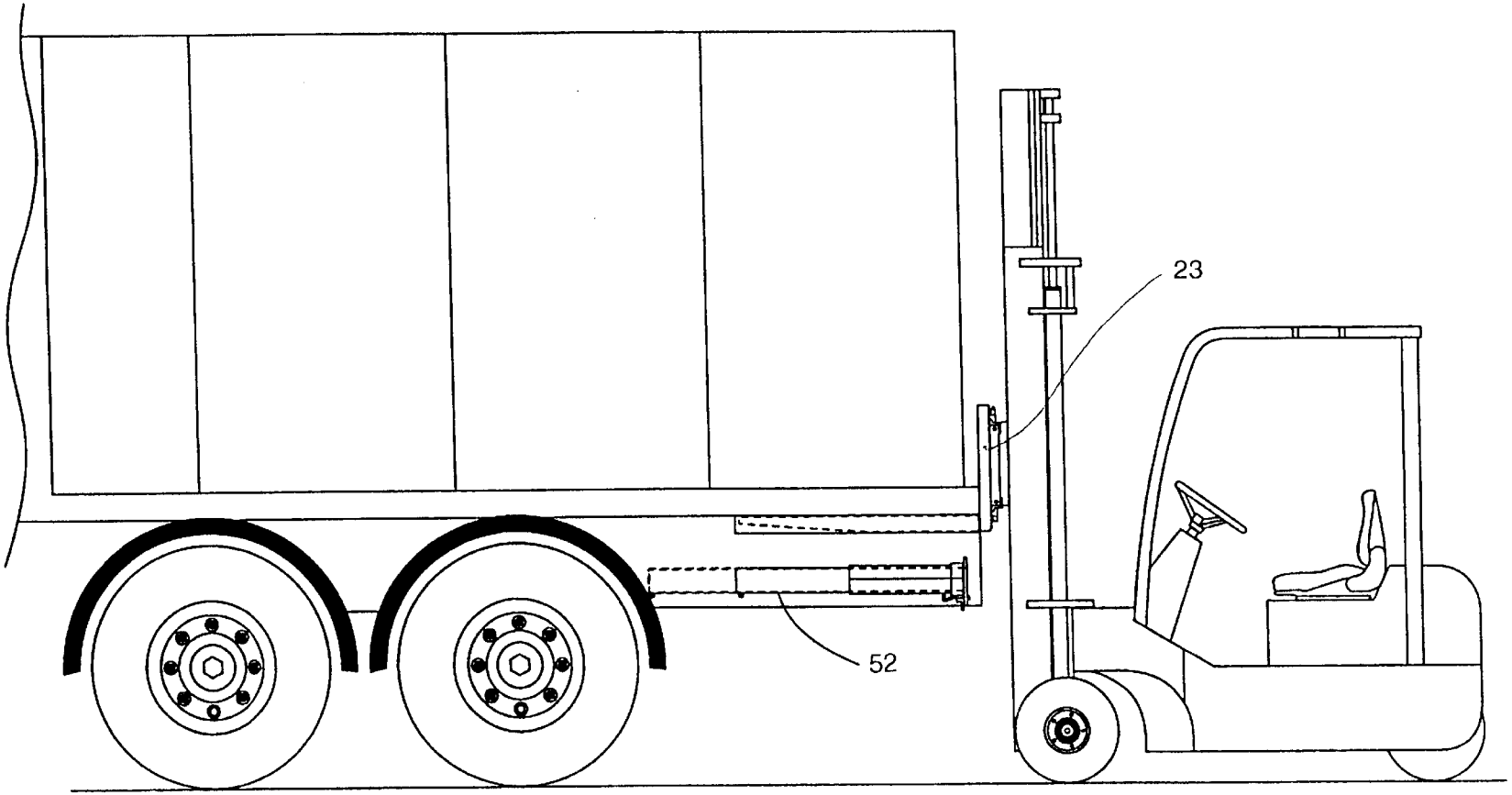
FIGS. 6 to 9 show schematically the sequence of loading operation of a fork lift truck according to the invention on the rear of a carrying vehicle.

In FIG. 6, the fork lift truck engages its forks 23 in a pocket fixed below the bed of the carrying vehicle. The driver then dismounts from the fork lift truck and fixes to the control panel of the fork lift truck a removable remote control, generally a cable to control the loading of the fork lift truck on the rear of the carrying vehicle, from the ground.

Figure 7:
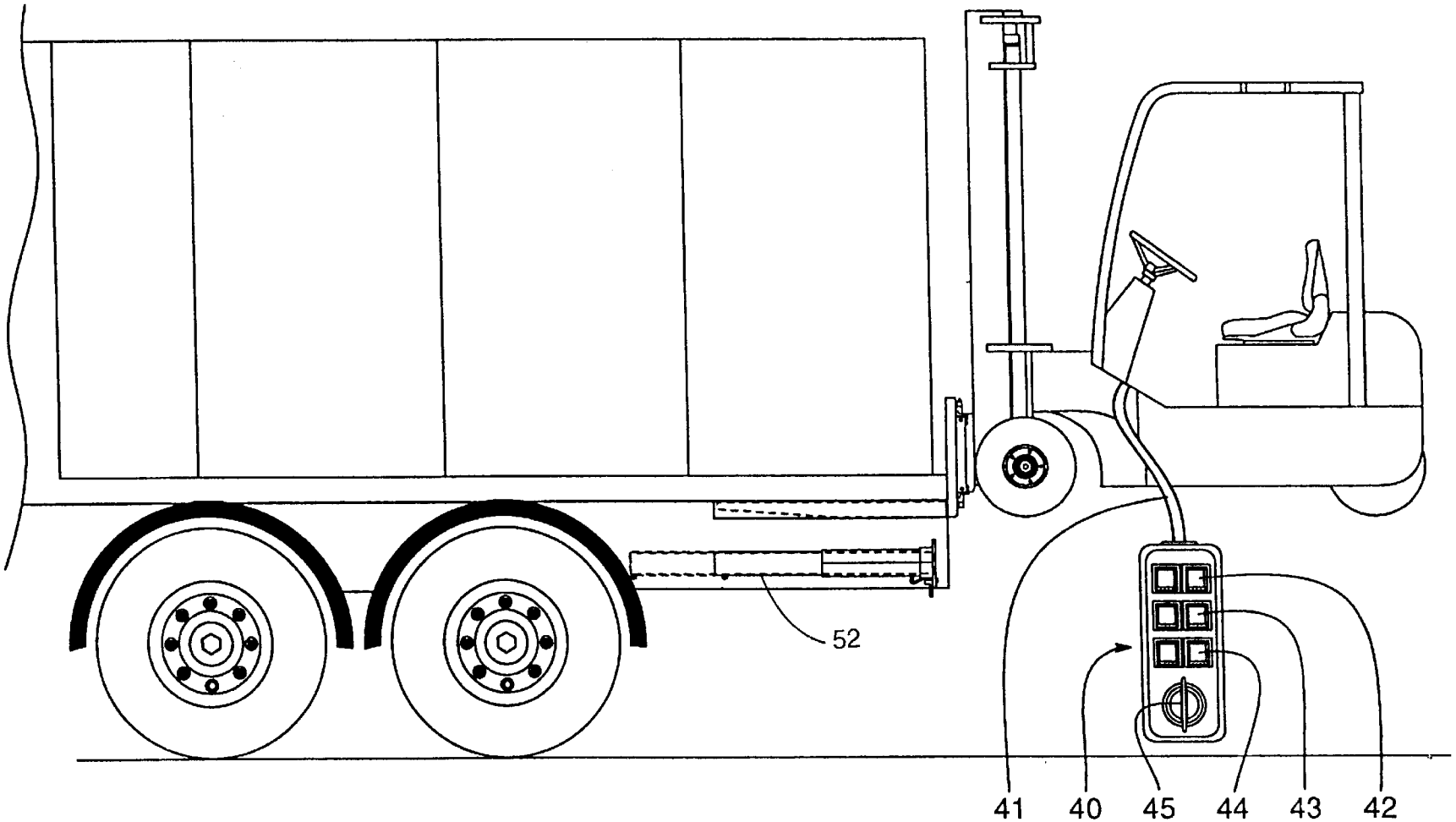

In FIG. 7, a control box 40 is fixed by a connecting cable 41 to the control panel of the fork lift truck. The control box 40 comprises electric switches 42 for raising and lowering the mast, electric switches 43 for the front and rear inclination of the inclinable apron 33 relative to the first apron 30, electric switches 44 for pivoting the chassis between the use position and the loading position, as well as means 45 for cutting or supplying electrical energy, generally a contact key.

The energy supply by means of the contact key 45 permits control by means of a switch 42 on the mast so as to raise the fork lift truck to a position corresponding substantially to the level of the bed of the carrying vehicle, above the level of sliding supports 52 fixed below the pockets. The front or rear inclination of the apron 33 is adjusted by switches 43 so that the fork lift truck will be substantially horizontal.

Figure 8:
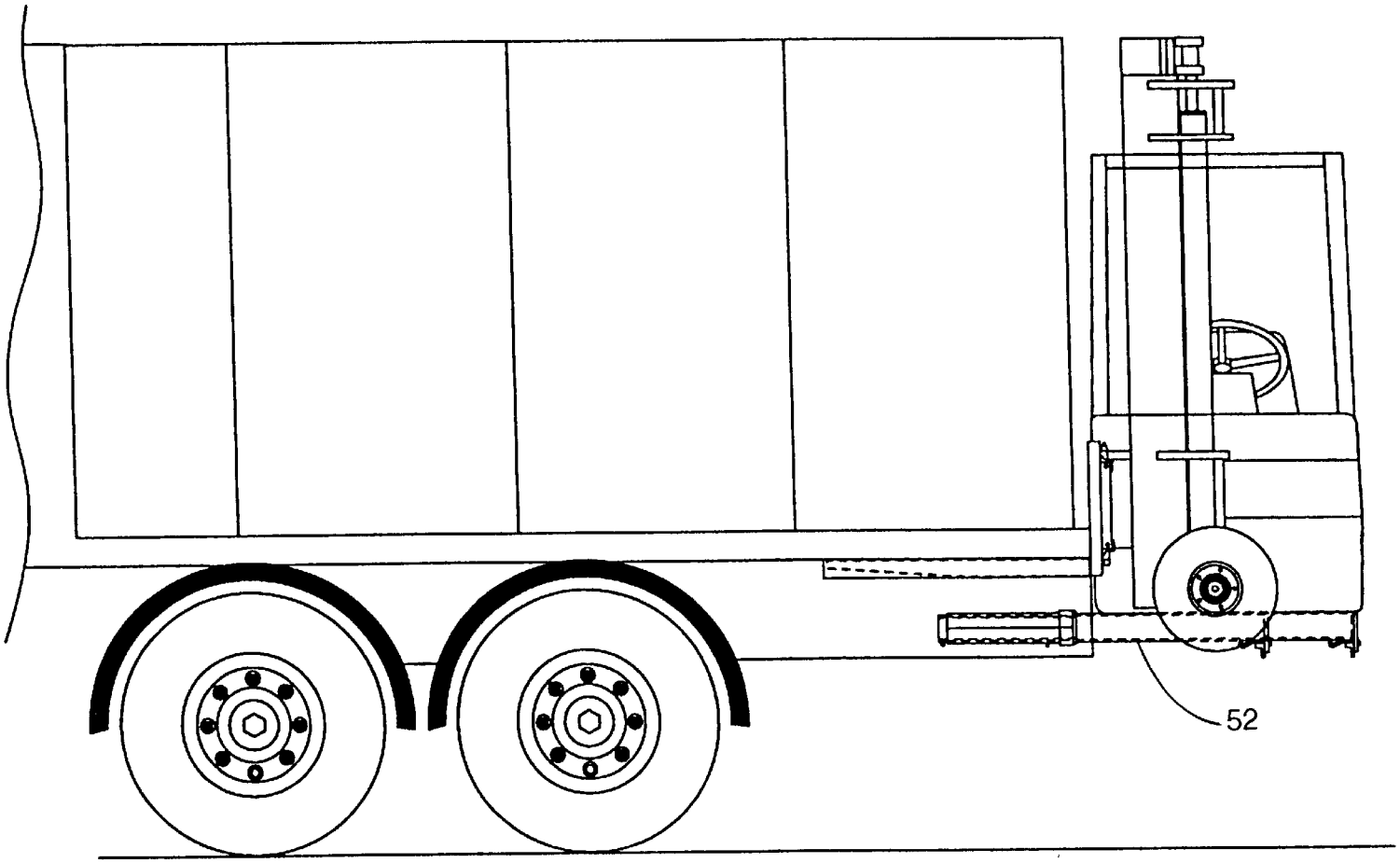
Figure 9:
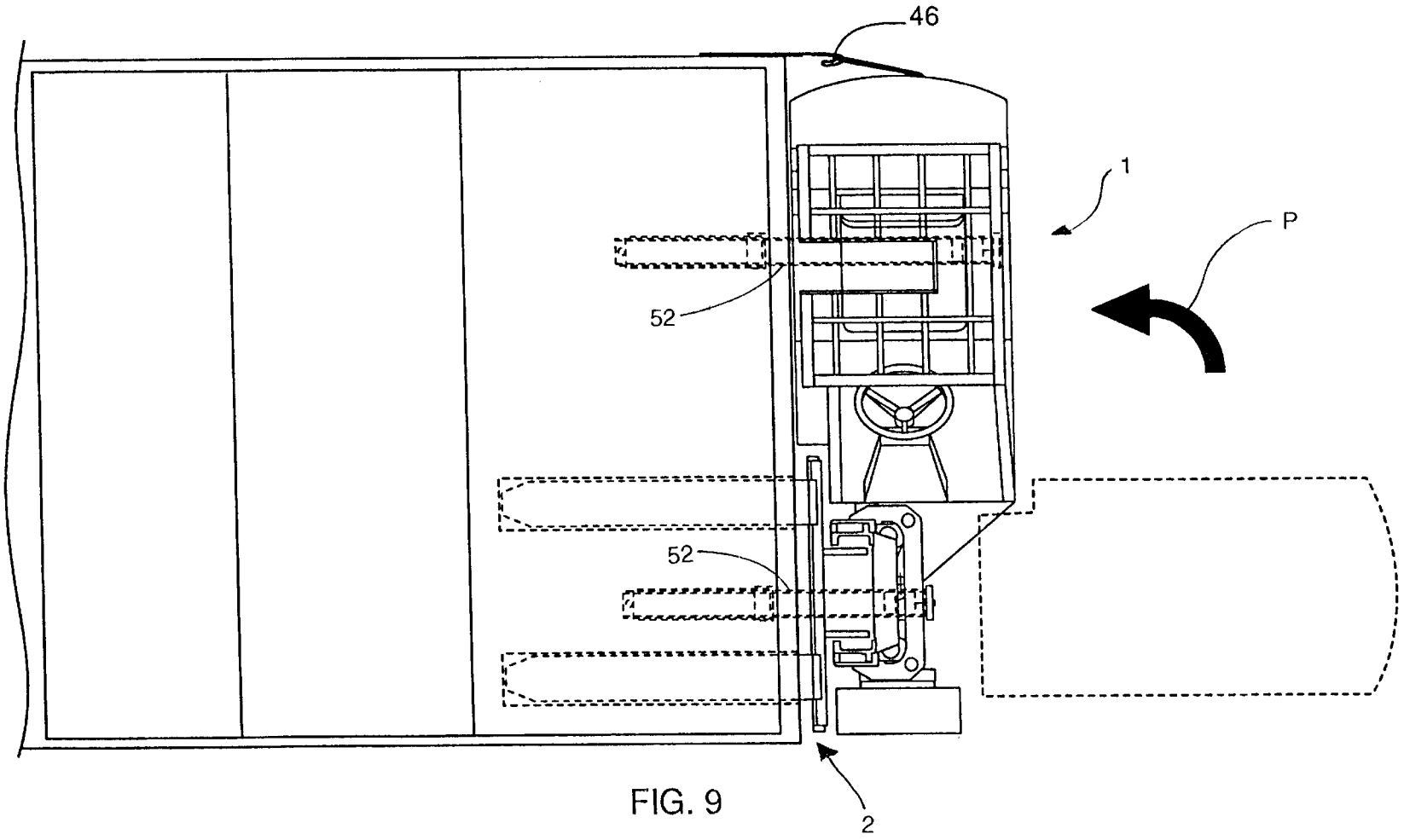
Figure 10:
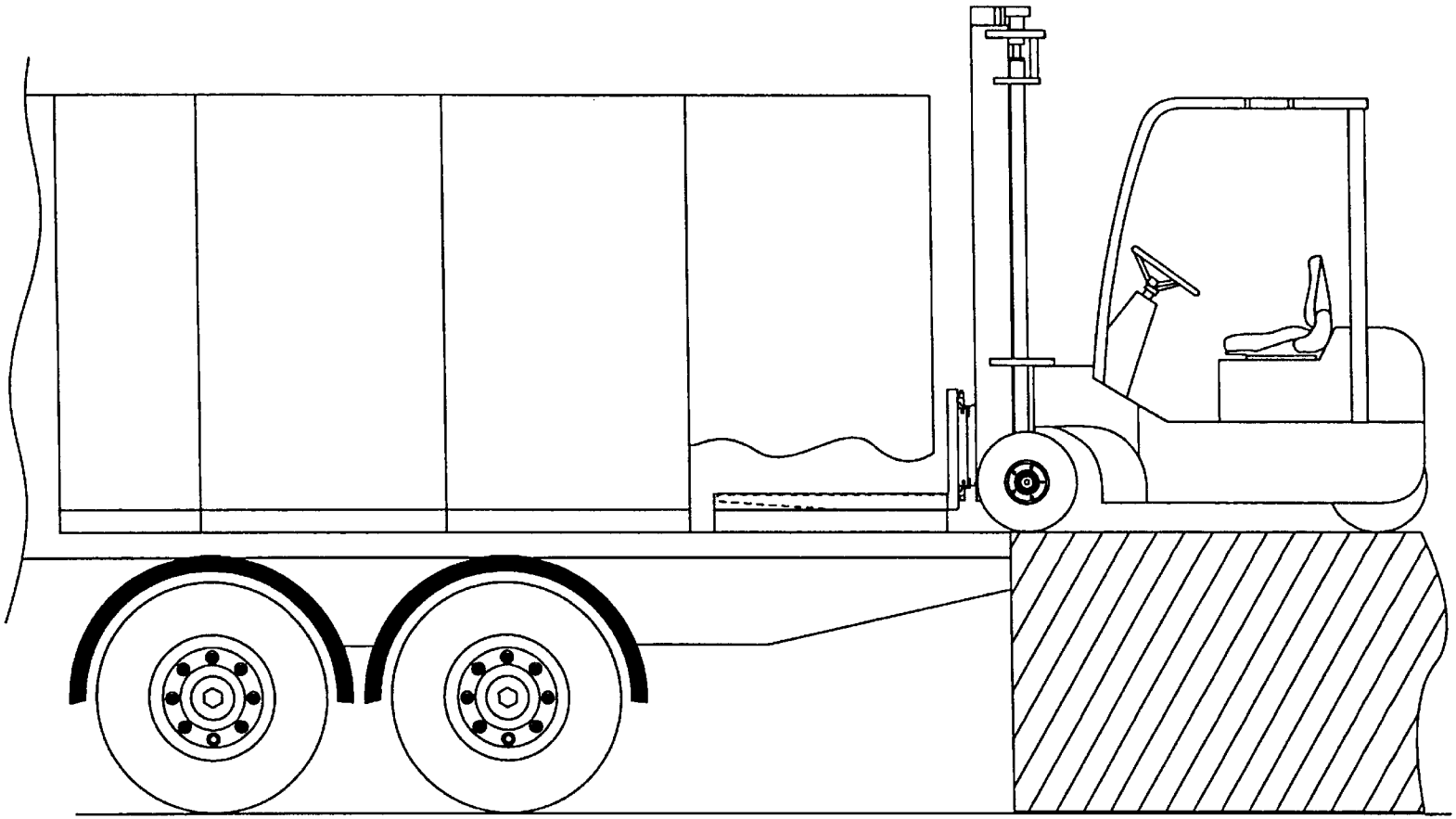
FIGS. 10 to 13 show schematically the sequence of loading operation on the bed of a carrying vehicle.
Figure 11:
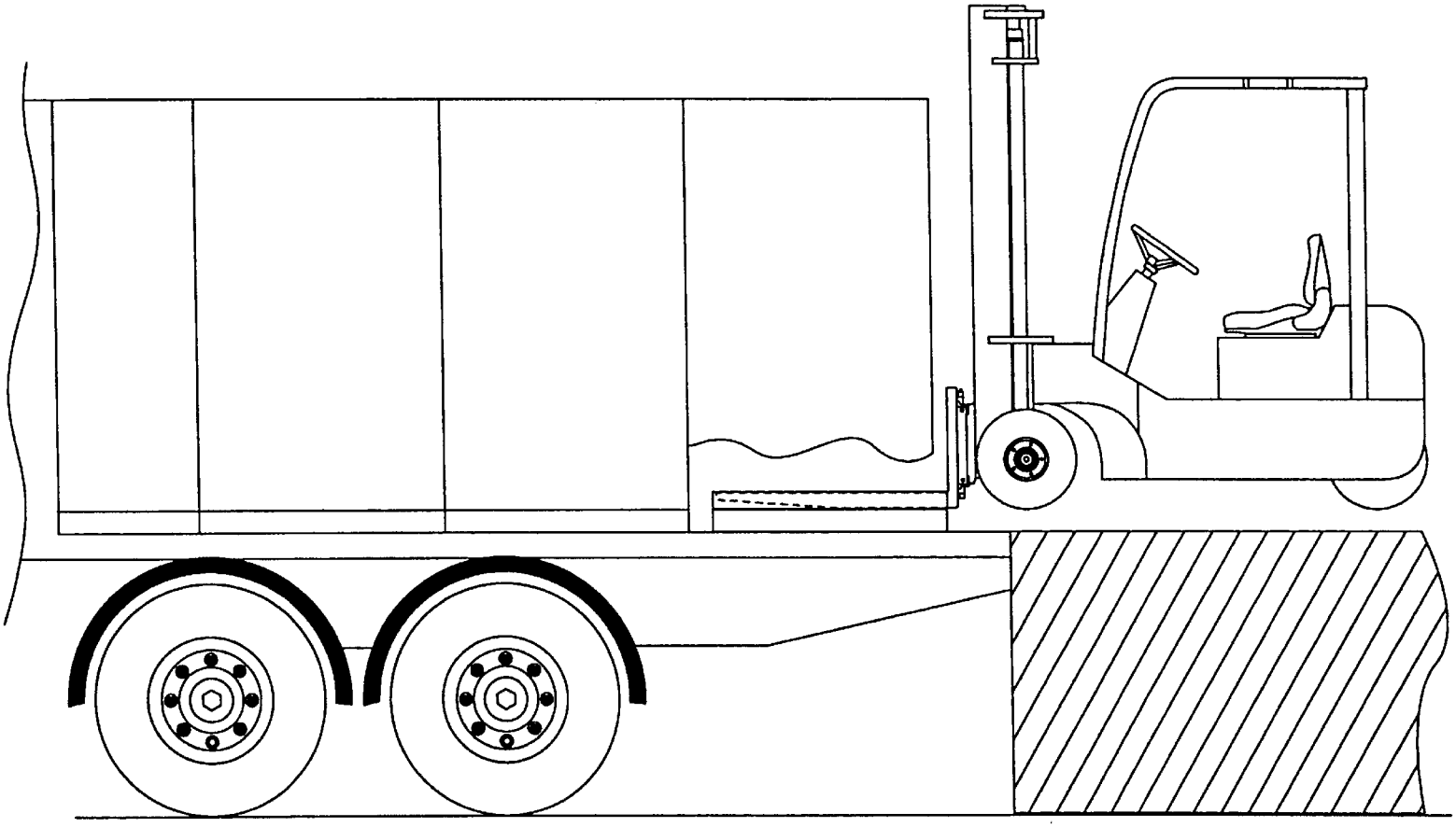
Figure 12:
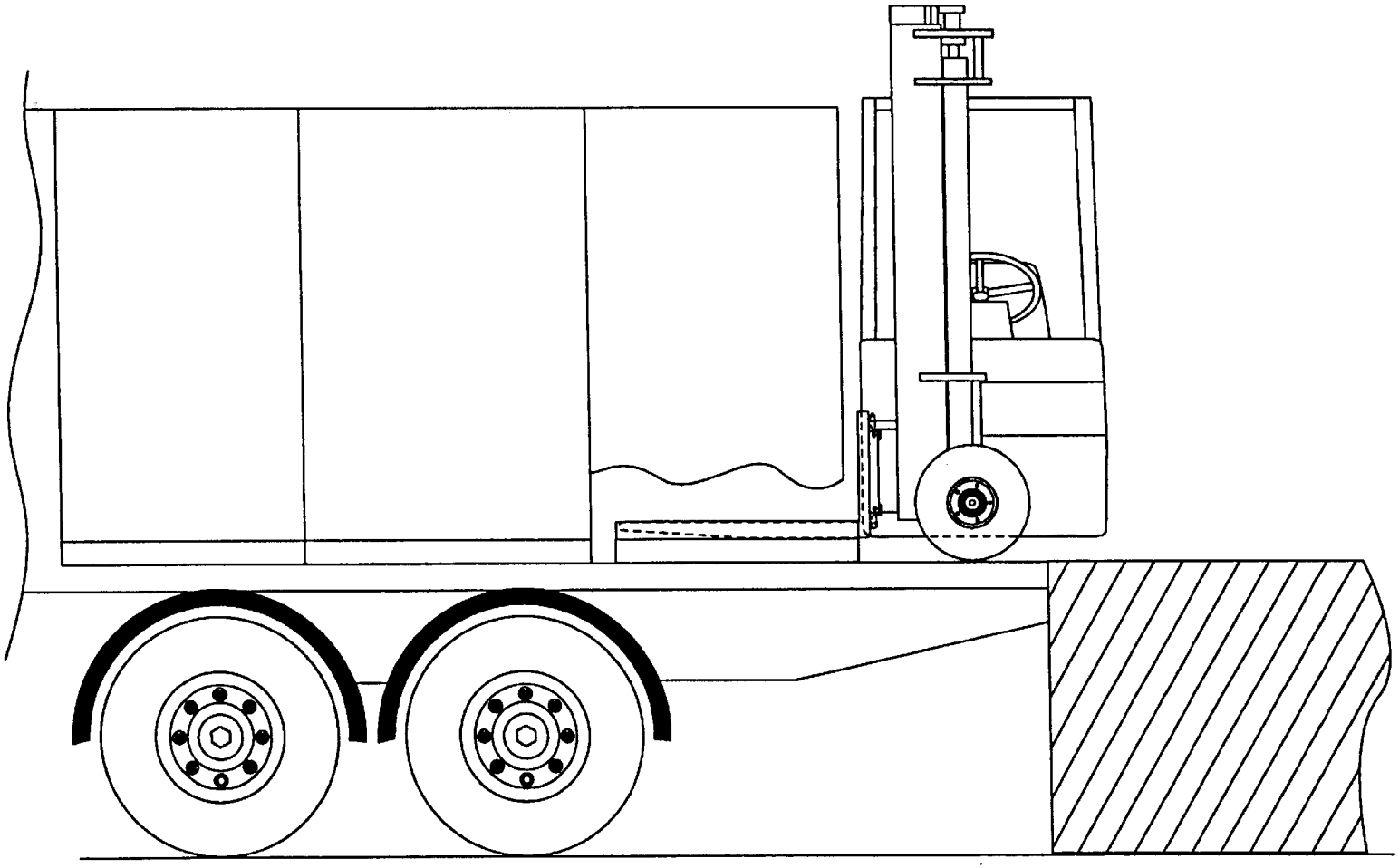
Figure 13:
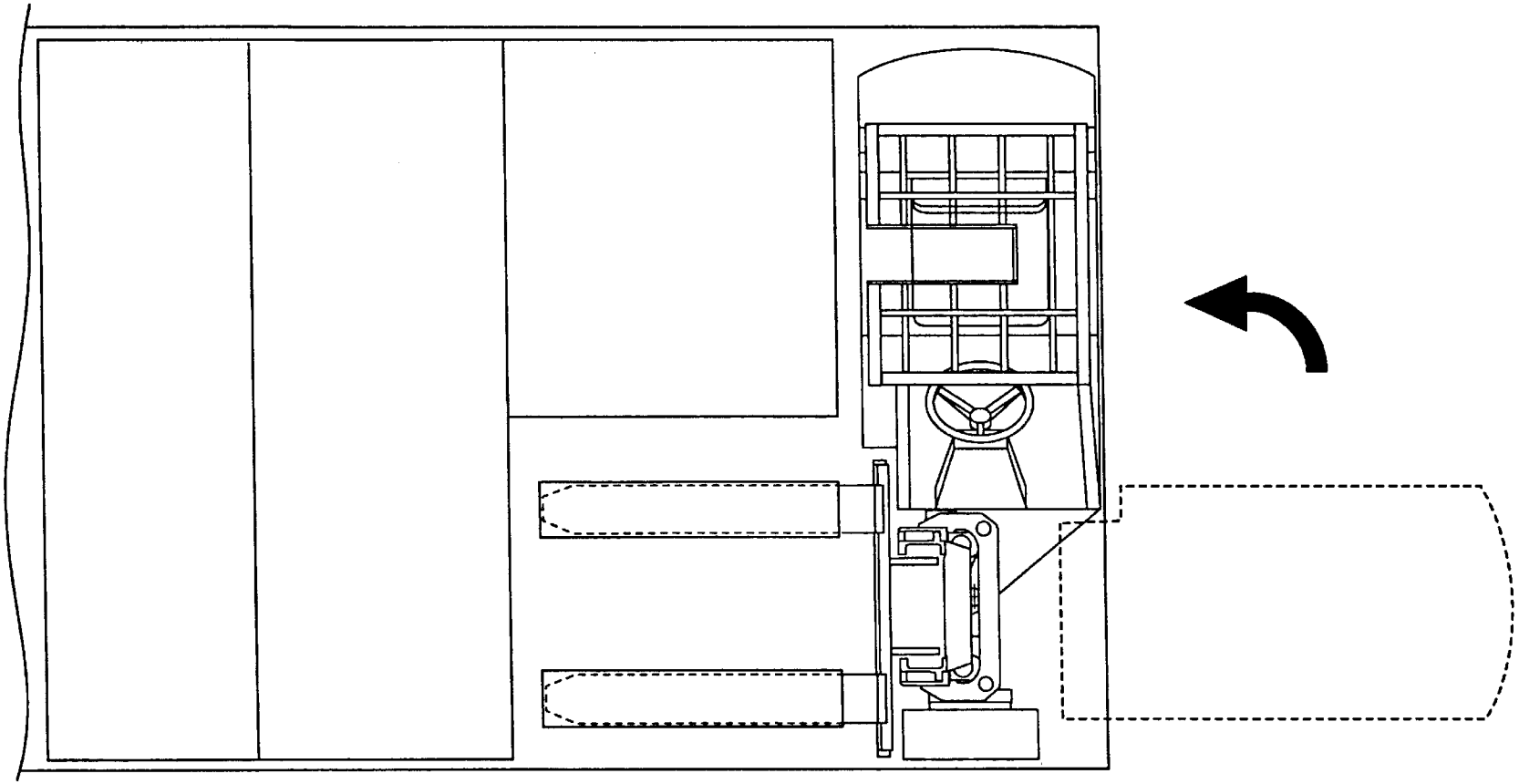

In FIGS. 8 and 9, the fork lift truck according to the invention has a loading position in which the chassis 1 is perpendicular to the front portion 2 immobilized in its pockets. Pivoting of the rear portion 1 relative to the front portion 2 in the direction of the arrow P is obtained by controlling the jack 26 by means of switches 44. After having achieved this pivoting, the sliding supports 52 are moved rearwardly of the fork lift and the chassis 1 of the fork lift is deposited on these supports by raising the mast, which causes descent of the chassis onto these supports. Preferably, a supplemental stay 46 can be provided for transport over long distances.

The loading of the fork lift truck according to the invention thus takes place with reduced encumbrance of the rear of the carrying vehicle, whilst permitting providing a fork lift of substantial length having stability and raising capacity greater than those of the prior art fork lift trucks.

In FIGS. 10 to 13, similarly to FIGS. 6 to 9, there has been shown the loading of the fork lift truck from a loading platform in the case in which the fork lift truck can be disposed directly on the bed of a truck provided with fork pockets.

In this case, it is not necessary to use remote control means with a cable or wireless, to control the loading of the fork lift truck. The driver can remain in the fork lift truck during the loading operation. The volume occupied by the loading of the fork lift truck according to the invention on the bed of the carrying vehicle is very much reduced. The bed of the carrying vehicle requires no modification, given that the fork pockets can be rapidly mounted and dismounted by means of retractable anchors not extending above the truck bed.

The invention having been described with reference to a particular embodiment, is not thereby limited, but covers on the contrary any modification of shape and all variations of embodiment within the scope and spirit of the invention.

What is claimed is:

1. A fork lift truck having a structure enabling loading said truck on a rear of a carrying vehicle, said structure comprising:

a chassis, a double-acting mast carrying forks, and three wheels, said three wheels comprising one powered and steerable rear wheel and two fixed-direction front wheels;

said truck comprising a front portion comprising said mast and said two front wheels; and said truck further comprising means for mounting said front portion for one side pivoting movement relative to said chassis about a substantially vertical axis so as to pivot between a first working position of the truck in which said front portion of the truck is substantially aligned with said chassis and a second position of loading the truck on a carrying vehicle in which said front portion and said chassis are substantially perpendicular to each other, whereby said first working position is for carrying and displacing loads and said second position is for transportation of the truck on a carrying vehicle.

2. Fork lift truck according to claim 1, wherein said vertical axis (3) is located substantially between the front wheels (16, 17) and adjacent the mast (21).

3. Fork lift truck according to claim 1, wherein the front wheels (16, 17) are disposed to the rear of a loading apron (22) carried by the mast (21) and are spaced apart a distance less than one meter.

4. Fork lift truck according to claim 3, wherein the loading apron (22) carried by the mast (21) comprises a first apron (30) carrying a second apron (33) inclinable under the action of an inclination jack (34).

5. Fork lift truck according to claim 1, wherein the chassis (1) has a recess (15) on a side corresponding to the perpendicular position of the front portion (2) relative to the chassis (1).

6. Fork lift truck according to claim 5, wherein said recess (15) is shaped to receive a said front wheel (16) in the loaded position of the fork lift truck.

7. Fork lift truck according to claim 1, wherein portable remote control means (40) with a cable (41) or wireless, is provided to control the loading of the fork lift on the rear of the carrying vehicle, from the ground.

8. Fork lift truck according to claim 7, wherein the remote control means (40) is adapted to execute the following functions: raising and lowering the forks, inclining the forks, pivoting the chassis between the first and second positions, and power shutdown and energy supply.

9. Fork lift truck according to claim 7, wherein the remote control means comprise a control box with electrical switches (42–44) and a contact key (45) for controlling the energy supply of the fork lift truck, and connection means (41) between the control box and the fork lift truck.

10. Fork lift truck according to claim 1, wherein the fork lift truck is an electric fork lift truck carrying an assembly of electrical batteries (11) below a driver's seat.

11. A fork lift truck adapted to be loaded on a carrying vehicle, the fork lift truck comprising:

a chassis comprising one wheel that supports an entirety of a rear of said chassis and that is powered and steerable;

a pivot assembly that asymmetrically extends from a front of said chassis forming a recess at only one side of said pivot assembly;

a front portion that is pivotally mounted to said pivot assembly on a substantially vertical axis and comprises two fixed-direction front wheels that support said front portion and the front of said chassis, said front portion pivoting between a working position in which said front portion is substantially aligned with said chassis for operation of the fork lift truck and a carrying position in which said front portion is substantially perpendicular to said chassis and one of said front wheels is in said recess for carrying the fork lift truck on a carrying vehicle, the asymmetrical extension of said pivot assembly preventing pivoting of said front portion to a position opposite to the carrying position; and a double-acting mast carrying forks that is carried by said front portion.

12. The fork lift truck of claim 11, wherein said pivot assembly comprises, in plan view, a generally triangular arm extending forwardly from only about one half of the front of said chassis, forming the recess in the other half of the front of said chassis.

13. The fork lift truck of claim 11, wherein said vertical axis is between said two front wheels and intersects or is immediately adjacent to a line joining centers of said two front wheels.

14. A fork lift truck comprising:

a chassis comprising one wheel that is powered and steerable;

a pivot arm that asymmetrically extends from one side portion of a front of said chassis forming a recess at another portion of the front of said chassis;

a front portion that is pivotally mounted to said pivot arm and comprises two front wheels, said front portion pivoting from a position in which said front portion is substantially aligned with said chassis to a first position in which said front portion is substantially perpendicular to said chassis and one of said front wheels is in said recess, the asymmetrical extension of said pivot arm allowing pivoting of said front portion only toward said first position; and a double-acting mast carrying forks that is carried by said front portion.

15. The fork lift truck of claim 14, wherein said pivot arm comprises, in plan view, a generally triangular arm extending forwardly from only about one half of the front of said chassis, forming the recess in the other half of the front of said chassis.

16. The fork lift truck of claim 14, wherein said front portion is pivotally mounted on a vertical axis that is between said two front wheels and intersects or is immediately adjacent to a line joining centers of said two front wheels.

* * * * *